US009927730B2

(12) United States Patent
Tokudome et al.

(10) Patent No.: US 9,927,730 B2
(45) Date of Patent: Mar. 27, 2018

(54) IMAGE FORMING APPARATUS THAT EFFECTS REMOVAL OF RESIDUAL TONER

(71) Applicant: CANON KABUSHIKI KAISHA, Tokyo (JP)

(72) Inventors: Makoto Tokudome, Yokohama (JP); Satoshi Sunahara, Hachioji (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/255,445

(22) Filed: Sep. 2, 2016

(65) Prior Publication Data

US 2017/0075248 A1 Mar. 16, 2017

(30) Foreign Application Priority Data

Sep. 15, 2015 (JP) ..... 2015-181542

(51) Int. Cl.

| | |
|---|---|
| ***G03G 21/00*** | (2006.01) |
| ***G03G 15/02*** | (2006.01) |
| ***G03G 21/18*** | (2006.01) |
| ***G03G 21/08*** | (2006.01) |

(52) U.S. Cl.

CPC ..... *G03G 15/0216* (2013.01); *G03G 21/08* (2013.01); *G03G 21/1814* (2013.01); *G03G 21/0064* (2013.01)

(58) Field of Classification Search

CPC . G03G 15/0216; G03G 21/08; G03G 21/1814
See application file for complete search history.

(56) References Cited

U.S. PATENT DOCUMENTS

| | | | | |
|---|---|---|---|---|
| 6,922,539 | B2 | 7/2005 | Uyama et al. | |
| 7,379,693 | B2 | 5/2008 | Ogawa et al. | |
| 7,447,454 | B2 | 11/2008 | Nishimura et al. | |
| 7,965,960 | B2 * | 6/2011 | Kim | G02B 6/001 399/128 |
| 8,682,220 | B2 * | 3/2014 | Miyaji | G03G 21/08 399/128 |
| 2008/0166158 | A1 * | 7/2008 | Takahashi | G03G 21/0064 399/302 |
| 2011/0058850 | A1 | 3/2011 | Shibuya | |

FOREIGN PATENT DOCUMENTS

| | | | |
|---|---|---|---|
| JP | 63-121881 | A | 5/1988 |
| JP | 02-203370 | A | 8/1990 |
| JP | 07-129051 | A | 5/1995 |
| JP | 09-90846 | A | 4/1997 |
| JP | 2001-142365 | A | 5/2001 |
| JP | 2004-118074 | A | 4/2004 |
| JP | 2005-114755 | A | 4/2005 |
| JP | 2006-301108 | A | 11/2006 |
| JP | 2012-173723 | A | 9/2012 |

OTHER PUBLICATIONS

Extended European Search Report dated Jan. 18, 2017, in European Patent Application No. 16187770.9.

* cited by examiner

*Primary Examiner* — Hoang Ngo
(74) *Attorney, Agent, or Firm* — Fitzpatrick, Cella, Harper & Scinto

(57) ABSTRACT

The length of a developer bearing portion of a developing device is longer than the length of a transfer roller in the rotation axis direction of a photosensitive drum. The width of a light irradiation opening of a charge eliminating device is shorter than the length of the transfer roller in the rotation axis direction of the photosensitive drum.

22 Claims, 9 Drawing Sheets

| | END PORTION COLLECTION FAILURE | END PORTION TONER RING | EDGE STAIN |
|---|---|---|---|
| FIRST EMBODIMENT | NOT OCCURRED | NOT OCCURRED | NOT OCCURRED |
| COMPARATIVE EXAMPLE | OCCURRED WHEN 50 SHEETS WERE FED | OCCURRED WHEN 100 SHEETS WERE FED | OCCURRED WHEN 200 SHEETS WERE FED |

IMAGE FORMING APPARATUS THAT EFFECTS REMOVAL OF RESIDUAL TONER

BACKGROUND OF THE INVENTION

Field of the Invention

The present invention relates to an image forming apparatus.

Description of the Related Art

As disclosed in Japanese Patent Application Laid-Open No. 2006-301108, a cleanerless system (a toner recycle system) has been conventionally proposed for image forming apparatuses such as electrophotographic apparatuses and electrostatic recording apparatuses in consideration of the simplification of an apparatus arrangement and the elimination of wastes. This cleanerless system does not use a dedicated drum cleaner as a surface cleaning unit after a transfer process with a photosensitive member in a transfer type image forming apparatus. This system cleans transfer residual toner on the photosensitive member after a transfer process by a developing device at the same time of developing (to be referred to as "developing with simultaneous cleaning" hereinafter) to remove the toner from the photosensitive member and collect the toner into the developing device to reuse it.

Developing with simultaneous cleaning is a method of collecting residual toner on a photosensitive member after a transfer process by using a fogging-removing bias (a fogging-removing potential difference Vback as the potential difference between a DC voltage applied to a developing device and the surface potential of the photosensitive member) at the time of developing after the next process. This method can eliminate waste toner and reduce a cumbersome manual operation for maintenance because the transfer residual toner is collected in the developing device and reused in the subsequent processes. In addition, this cleanerless arrangement provides a large advantage in terms of space, and hence allows a large reduction in the size of an image forming apparatus.

If there is residual charge on the photosensitive member, the surface potential of the photosensitive member is disturbed. For this reason, under a low-humidity environment, in particular, an image defect called a "drum positive ghost" sometimes occurs in the rotation cycle of the photosensitive member due to a charged potential difference on the photosensitive member. As disclosed in Japanese Patent Application Laid-Open No. 2001-142365, it is known that, in order to eliminate this "drum positive ghost", it is effective to provide a so-called charge eliminating unit for charge eliminating the surface potential of the photosensitive member to a predetermined residual potential level by irradiating the surface of the photosensitive member with light before a charging process after a transfer process.

When a charge eliminating unit is mounted in an image forming apparatus having the cleanerless system, the inventors have studied and found that the following problem occurs.

More specifically, if the relationship between the light irradiation width of a charge eliminating unit and a transfer member width is improper in the rotation axis direction of a photosensitive member, a trouble sometimes occurs at an end portion of the photosensitive member.

SUMMARY OF THE INVENTION

The present invention enables to suppress a trouble at an end portion of a photosensitive member.

An object of the present invention is to provide an image forming apparatus, which forms an image on a recording medium, including: an image bearing member; a charging device coming into contact with the image bearing member at a charging portion to charge the image bearing member; a developing device supplying developer to the image bearing member to form a developer image; a transfer member transferring the developer image formed on the image bearing member onto a transfer target material at a transfer portion; and a charge eliminating device irradiating a surface of the image bearing member with light from an exposure opening before the surface reaches the charging portion after passing through the transfer portion, wherein a length of a developer bearing portion of the developing device is longer than a length of the transfer member in a rotation axis direction of the image bearing member, and a width of the exposure opening of the charge eliminating device is shorter than the length of the transfer member in the rotation axis direction of the image bearing member.

It is another object of the present invention to provide an image forming apparatus, which forms an image on a recording medium, including: an image bearing member; a charging device coming into contact with the image bearing member at a charged portion to charge the image bearing member; a developing device supplying developer to the image bearing member to form a developer image; a transfer member transferring the developer image formed on the image bearing member onto a transfer target material at a transfer portion; and a charge eliminating device having a light source and a reflecting portion and irradiating a surface of the image bearing member with light which is emitted from the light source and reflected by the reflecting portion before the surface reaches the charged portion after passing through the transfer portion, wherein a length of a developer bearing portion of the developing device is longer than a length of the transfer member in a rotation axis direction of the image bearing member, and a width of the reflecting portion of the charge eliminating device is equal to or shorter than the length of the transfer member in the rotation axis direction of the image bearing member.

It is another object of the present invention to provide an image forming apparatus, which forms an image on a recording medium, including: an image bearing member; a charging device coming into contact with the image bearing member at a charged portion to charge the image bearing member; a developing device supplying developer to the image bearing member to form a developer image; a transfer member transferring the developer image formed on the image bearing member onto a transfer target material at a transfer portion; and a charge eliminating device irradiating a surface of the image bearing member with light from an exposure opening before the surface reaches the charged portion after passing through the transfer portion, wherein a length of a developer bearing portion of the developing device is longer than a length of the transfer member in a rotation axis direction of the image bearing member, and in a distribution of light reception amounts on the image bearing member from the charge eliminating device in the rotation axis direction of the image bearing member, a maximum value of a light reception amount in a region outside a region corresponding to the transfer member on the image bearing member is smaller than a maximum value of a light reception amount in the region corresponding to the transfer member on the image bearing member.

It is another object of the present invention to provide a cartridge to be mounted in an image forming apparatus which has a transfer member transferring a developer image formed on an image bearing member onto a transfer target material at a transfer portion, the cartridge including: the image bearing member; a charging member coming into contact with the image bearing member at a charged portion to charge the image bearing member; and a lightguide unit having an exposure opening from which a surface of the image bearing member is irradiated with light before the surface reaches the charged portion after passing through the transfer portion, and wherein a width of the exposure opening of the charge eliminating device is shorter than a length of the transfer member in a rotation axis direction of the image bearing member.

It is another object of the present invention to provide a cartridge to be mounted in an image forming apparatus having a light source and a transfer member transferring a developer image formed on an image bearing member onto a transfer target material at a transfer portion, the cartridge including: the image bearing member; a charging member coming into contact with the image bearing member at a charged portion to charge the image bearing member; and a lightguide unit having a reflecting portion and irradiating a surface of the image bearing member with light, which is emitted from the light source and reflected by the reflecting portion, before the surface reaches the charged portion after passing through the transfer portion, and wherein a width of the reflecting portion of the lightguide unit is equal to or shorter than a length of the transfer member in a rotation axis direction of the image bearing member.

Further features of the present invention will become apparent from the following description of exemplary embodiments with reference to the attached drawings.

DESCRIPTION OF THE EMBODIMENTS

An image forming apparatus according to an embodiment of the present invention will be described in detail with reference to the accompanying drawings. The dimensions, materials, shapes, and relative positions of components described in each embodiment are changed, as needed, in accordance with the arrangement of an apparatus to which the present invention is applied and various types of conditions. For this reason, the scope of the present invention is not limited to only them unless otherwise specified.

First Embodiment

The arrangement of an image forming apparatus according to the first embodiment will be described with reference to FIGS. 1 to 8.

<Image Forming Apparatus>

Figure 1:
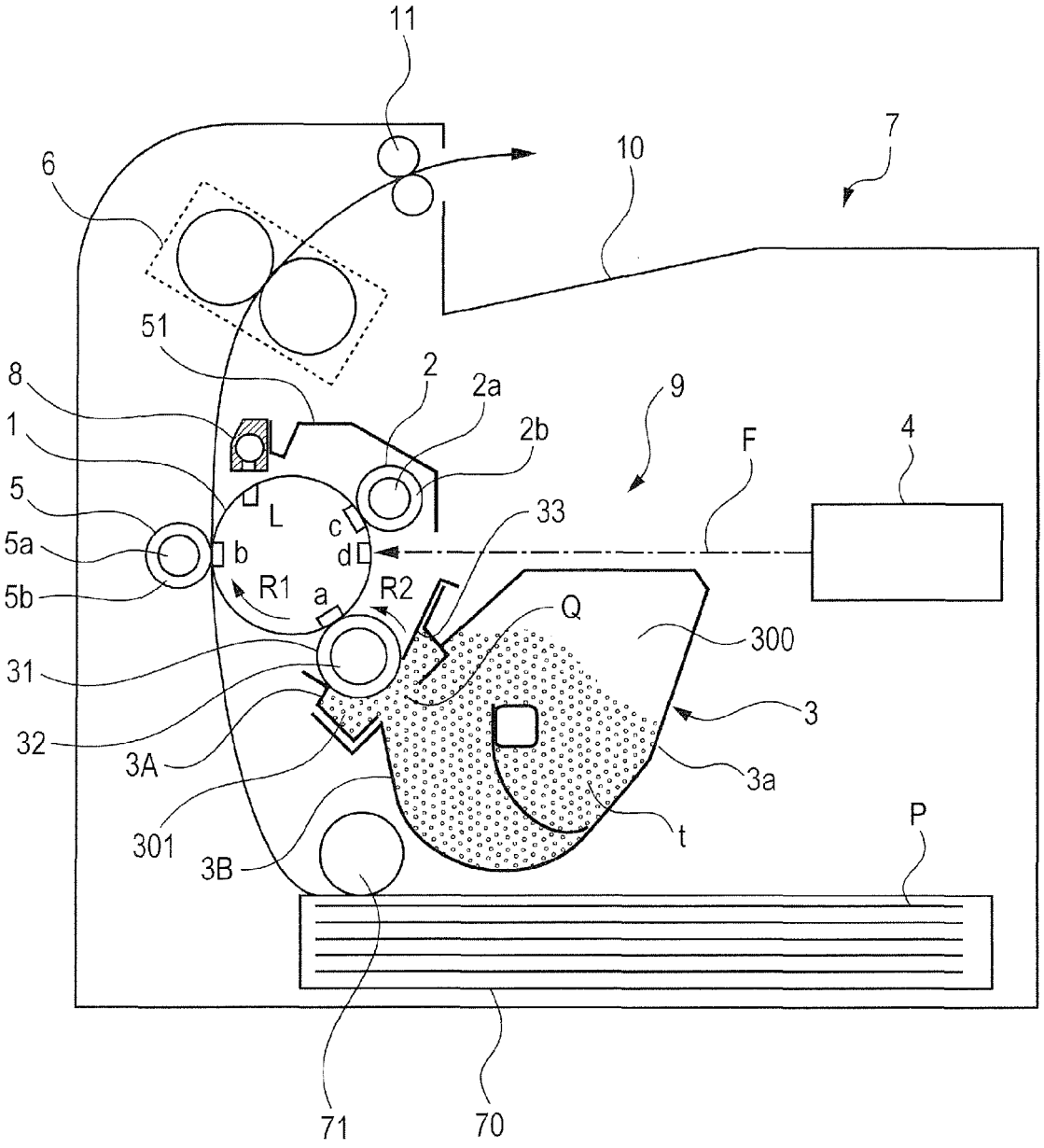
FIG. 1 is a sectional view for explaining the arrangement of an image forming apparatus according to the first embodiment.

The arrangement of the image forming apparatus according to the first embodiment will be described with reference to FIG. 1. FIG. 1 is a sectional view for explaining the arrangement of the image forming apparatus according to the first embodiment. This embodiment will exemplify a monochrome laser printer using a transfer type electrophotographic process as an example of the image forming apparatus according to this embodiment.

An image forming apparatus 7 shown in FIG. 1 includes a photosensitive drum 1 as an image bearing member, and a charging roller 2 serving as a charging device which uniformly charges the surface of the photosensitive drum 1 by coming into contact with the surface of the photosensitive drum 1.

The image forming apparatus 7 further includes a developing device 3. The developing device 3 supplies toner onto the surface of photosensitive drum 1 by causing the surface of a developing sleeve 31, which serves as a developer bearing member, to carry toner as a developer. Thereby, an electrostatic latent image formed on the surface of the photosensitive drum 1 is developed as a toner image.

When toner on the surface of the photosensitive drum 1 (on an image bearing member) is transferred onto a recording medium P as a transfer target medium, the developing device 3 collects residual toner on the surface of the photosensitive drum 1 into a developer container 3*a* (a developing device).

The image forming apparatus 7 includes a laser scanner 4 as an exposure unit. The image forming apparatus 7 further includes a transfer roller 5 serving as a transfer member which transfers a toner image (a developer image) formed on the surface of the photosensitive drum 1 onto the recording medium P and a fixing device 6 serving as a fixing unit.

The image forming apparatus 7 further detachably includes a process cartridge 9 having the photosensitive drum 1, the charging roller 2, and the developing device 3 integrated into a cartridge.

The photosensitive drum 1 according to this embodiment is a negative OPC (Organic Photo Conductor) photosensitive member having an outer diameter of 24 mm. The photosensitive drum 1 is provided to be rotatable at a peripheral velocity (a process speed or a printing speed) of 100 mm/sec in the arrow R1 direction in FIG. 1. In the following description, the rotation axis direction of the photosensitive drum 1 is referred to as the longitudinal direction of the photosensitive drum 1.

The charging roller (a charging member) 2 uniformly charges the surface of the photosensitive drum 1. The charging roller 2 is formed from a conductive elastic roller having a core metal 2*a* and a conductive elastic layer 2*b* covering the outer circumference of the core metal 2*a*.

The charging roller 2 is in pressure contact with the surface of the photosensitive drum 1 with a predetermined pressing force. A portion of the surface of the photosensitive drum 1 which comes into pressure contact with the charging roller 2 will be referred to as a charged portion (a charging position) c. The charging roller 2 rotates together with the rotation of the photosensitive drum 1.

The image forming apparatus 7 includes a charging power supply which applies a charging bias to the charging roller 2. The charging power supply applies a DC voltage to the core metal 2*a* of the charging roller 2. This DC voltage is set to a value that makes the potential difference between the surface potential of the photosensitive drum 1 and the potential of the charging roller 2 become equal to or more than a discharge start voltage. More specifically, a DC voltage of −1,300 V is applied as a charging bias from the charging power supply to the charging roller 2. At this time, the surface potential (dark part potential) of the photosensitive drum 1 is uniformly charged to −700 V.

The laser scanner 4 includes a laser diode and a polygon mirror. The laser scanner 4 outputs a laser beam F which is intensity-modulated in accordance with a time-series electrical digital pixel signal of target image information. The laser scanner 4 irradiates the surface of the photosensitive drum 1, which is uniformly charged by the charging roller 2, with the laser beam F, thus performing scanning exposure.

The laser output of the laser scanner 4 is adjusted such that, when the surface of the photosensitive drum 1 is entirely exposed with the laser beam F, the surface potential (exposed part potential $V_L$) of the photosensitive drum 1 becomes −150 V.

The developing device 3 includes a developing chamber 301 including a first frame 3A and a toner storage chamber 300 including a second frame 3B. The developing device 3 has a supply opening Q communicating the developing chamber 301 with the toner storage chamber 300.

The developing chamber 301 is provided with the developing sleeve 31 serving as a developer bearing member and a regulating blade 33 serving as a regulating member. The toner storage chamber 300 stores magnetic toner t as a developer.

The magnetic toner t is attracted to the surface of the developing sleeve 31 by the magnetic force of a magnet roller 32 as a magnetic field generation unit enclosed in the developing sleeve 31.

A region of the surface of the developing sleeve 31 which is coated with the magnetic toner t will be referred to as a developer bearing portion D. The magnetic toner t is uniformly friction-charged to negative polarity. The magnetic toner t is then supplied to an electrostatic latent image on the surface of the photosensitive drum 1 at a developing portion (a developing position) a by a developing bias applied between the developing sleeve 31 and the photosensitive drum 1 by a developing bias application power supply. The electrostatic latent image is then developed as a toner image to be visualized.

The developing bias in this embodiment is set to −350 V. The developing portion a is a region of the surface of the photosensitive drum 1 which faces the developing sleeve 31. The developing sleeve 31 supplies developer to this region.

The intermediate-resistance transfer roller 5 as a contact type transfer member is in pressure contact with the surface of the photosensitive drum 1. A portion of the surface of the photosensitive drum 1 which is in pressure contact with the transfer roller 5 will be referred to as a transfer portion (a transfer position) b. The transfer roller 5 according to this embodiment includes a conductive core metal 5*a* and an intermediate-resistance foamed layer 5*b* covering the outer circumference of the core metal 5*a*.

The transfer roller 5 has an electric resistance value of $5\times10^8\Omega$. A transfer bias voltage of +2.0 kV is applied to the core metal 5*a* to transfer a toner image formed on the surface of the photosensitive drum 1 onto the recording medium P as transfer target material.

A fixing device 6 heats and pressurizes the recording medium P, which has passed through a transfer portion b and onto which the toner image has been transferred, to fix the toner image on the recording medium P. Thereafter, the recording medium P on which the toner image is fixed is delivered onto a delivery tray 10 provided outside the image forming apparatus 7.

<Image Forming Operation>

The image forming operation of the image forming apparatus 7 will be described with reference to FIG. 1. First of all, a print signal is input to a controller serving as a control unit for the main body of the image forming apparatus 7. The image forming apparatus 7 then starts an image forming operation.

Each driving unit starts to operate at a predetermined timing to apply each voltage. The charging roller 2 uniformly charges the surface of the photosensitive drum 1 which is driven to rotate in the arrow R1 direction in FIG. 1. The uniformly charged photosensitive drum 1 is exposed with the laser beam F corresponding to image information output from the laser scanner 4, thereby forming an electrostatic latent image on the surface of the photosensitive drum 1. Thereafter, the developing sleeve 31 supplies the magnetic toner t (developer) to this electrostatic latent image to visualize it as a toner image (a developer image).

A feed roller 71 picks up the recording medium P from a feed cassette 70 and separately feeds it one by one in cooperation with a separation unit (not shown). The recording medium P is fed to the transfer portion b in synchronism with the image formation timing of a toner image on the surface of the photosensitive drum 1.

The toner image visualized on the surface of the photosensitive drum 1 is transferred onto the recording medium P by the effect of the transfer roller 5. The recording medium P on which the toner image is transferred is conveyed to the fixing device 6. A fixing roller and a pressure roller provided in the fixing device 6 perform nipping-conveyance of the recording medium P. During the nipping-conveyance, the unfixed toner image on the recording medium P is permanently fixed on the recording medium P by being heated and pressurized. Subsequently, delivery rollers 11 perform nipping-conveyance of the recording medium P to deliver it outside the apparatus.

<Cleanerless System>

The cleanerless system according to this embodiment will be described. In this embodiment, transfer residual toner left on the surface of the photosensitive drum 1 without being transferred at the transfer portion b is removed as follows. The embodiment uses a so-called cleanerless system which does not use a cleaning member removing the transfer residual toner from the surface of the photosensitive drum 1 before the toner reaches the charging position at which the toner is charged by the charging roller 2. This cleaning member is a cleaning blade which comes into contact with the surface of the photosensitive drum 1 to scrape off toner on the surface of the photosensitive drum 1.

The transfer residual toner left on the surface of the photosensitive drum 1 after the transfer process is charged to negative polarity like the surface of the photosensitive drum 1 by discharge in an air gap portion on the upstream side of the charged portion c in the rotating direction of the photosensitive drum 1 which is driven to rotate in the arrow R1 direction in FIG. 1.

At this time, the surface of the photosensitive drum 1 is charged to −700 V. The transfer residual toner charged to negative polarity does not adhere to the surface of the charging roller 2 and passes through the charging roller 2 owing to the relationship in potential difference between the surface potential of the photosensitive drum 1, which is −700 V, and the potential of the charging roller 2, which is −1,300 V, at the charged portion c.

The transfer residual toner which has passed through the charged portion c reaches a laser irradiation position d, which is irradiated with the laser beam F, of the surface of the photosensitive drum 1. The amount of transfer residual toner is not large enough to shield against the laser beam F. For this reason, the transfer residual toner has no influence on the process of forming an electrostatic latent image on the surface of the photosensitive drum 1.

The developing sleeve 31 collects transfer residual toner, which is on a non-exposure portion (the surface of the photosensitive drum 1 which is not irradiated with the laser beam F), of the transfer residual toner having passed through the laser irradiation position d, with an electrostatic force at the developing portion a.

Transfer residual toner, which is on an exposure portion (the surface of the photosensitive drum 1 which is irradiated with the laser beam F), of the transfer residual toner having passed through the laser irradiation position d, remains on the surface of the photosensitive drum 1 without being collected with an electrostatic force.

A part of transfer residual toner is sometimes collected with a physical force based on the peripheral velocity difference between the peripheral velocity of the developing sleeve 31 and the peripheral velocity of the photosensitive drum 1. Transfer residual toner left on the surface of the photosensitive drum 1 is mostly collected in the developing device 3 without being transferred onto the recording medium P. The transfer residual toner collected in the developing device 3 is reused by being mixed with toner left in the developing device 3.

In this embodiment, in order to set the charged polarity of transfer residual toner to negative polarity to let the toner pass through the charged portion c, the charging roller 2 is driven to rotate with a predetermined peripheral velocity difference being provided with respect to the peripheral velocity of the photosensitive drum 1.

The charging roller 2 and the photosensitive drum 1 are driven to rotate with a predetermined peripheral velocity difference being provided between them. This causes friction between the surface of the photosensitive drum 1 and the surface of the charging roller 2 to charge transfer residual toner to negative polarity. This suppresses toner from adhering to the charging roller 2.

In this embodiment, the core metal 2*a* of the charging roller 2 is provided with a charging roller gear. The charging roller gear meshes with a drum gear provided on an end portion of the photosensitive drum 1. With this arrangement, the charging roller 2 is driven to rotate as the photosensitive drum 1 is driven to rotate. The peripheral velocity of the surface of the charging roller 2 according to this embodiment is set to 115% of the peripheral velocity of the surface of the photosensitive drum 1.

<Charge Eliminating Device>

Figure 2:
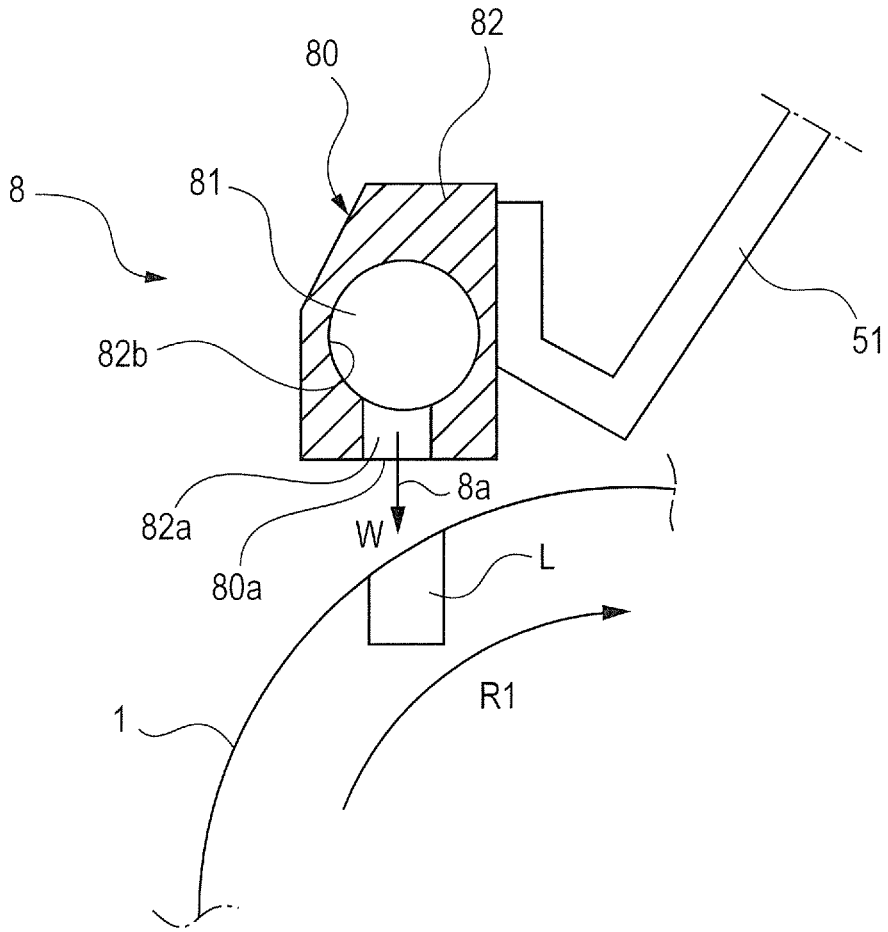
FIG. 2 is a sectional view for explaining the arrangement of a charge eliminating device according to the first embodiment.
Figure 3:
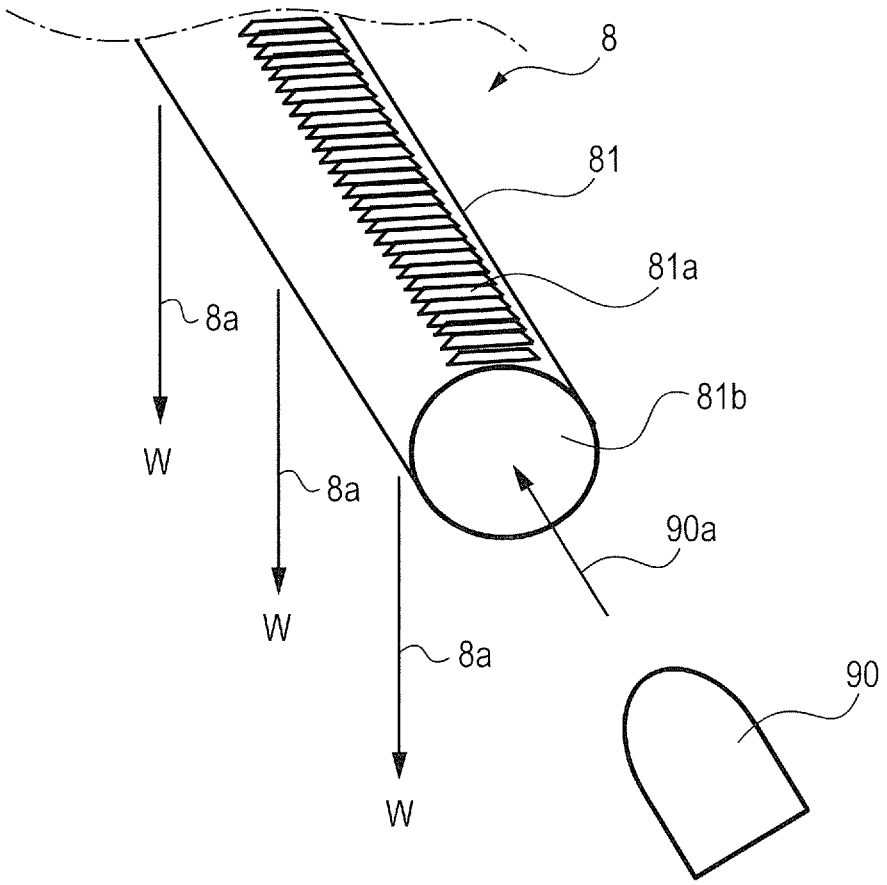
FIG. 3 is a perspective view for explaining the arrangement of the lens of the charge eliminating device according to the first embodiment.

The arrangement of a charge eliminating device 8 serving as a charge eliminating unit according to this embodiment will be described with reference to FIGS. 2 and 3. FIG. 2 is a sectional view for explaining the arrangement of the charge eliminating device 8 according to this embodiment. FIG. 3 is a perspective view for explaining the arrangement of a lens 81 of the charge eliminating device 8 according to this embodiment.

As shown in FIGS. 2 and 3, the charge eliminating device 8 includes an LED (a Light Emitting Diode) lamp 90 serving as a light source and a lightguide 80. A portion of the surface of the photosensitive drum 1 which is charge-eliminated by the charge eliminating device 8 will be referred to as a charge-eliminated portion L.

The charge eliminating device 8 charge-eliminates the surface potential of the photosensitive drum 1 after a transfer process performed by the transfer roller 5 and before a charging process performed by the charging roller 2. For this purpose, the charge eliminating device 8 irradiates the surface of the photosensitive drum 1 with charge eliminating light 8*a* (light) in the arrow W direction in FIGS. 2 and 3. This charge-eliminates the surface potential of the photosensitive drum 1 to a predetermined potential.

The surface potential of the photosensitive drum 1 which is charge-eliminated by the charge eliminating device 8 by irradiating the surface of the photosensitive drum 1 with the charge eliminating light 8*a* can be set to equal to or lower than an exposure part potential $V_L$.

This can eliminate a drum positive ghost on the surface of the photosensitive drum 1. In this embodiment, the charge eliminating device 8 sets the surface potential of a desired region of the photosensitive drum 1 to about the exposure part potential $V_L$ (about −150 V) before a charging process using the charging roller 2.

The LED lamp 90 shown in FIG. 3 is provided on the main body side of the image forming apparatus 7. The lightguide 80 shown in FIG. 2 is provided as a lightguide unit on the process cartridge 9 side.

The lightguide 80 is arranged on the downstream side of the transfer portion b shown in FIG. 1 in the rotating direction (the arrow R1 direction in FIG. 1) of the photosensitive drum 1 and on the upstream side of the charged portion c in the rotating direction (the arrow R1 direction in FIG. 1) of the photosensitive drum 1.

The lightguide 80 is fixed to a frame 51 of the process cartridge 9 with a fixing means such as a double-sided adhesive tape.

The axial direction of the lightguide 80 is almost parallel to the axial direction of the photosensitive drum 1. At least one axial end face of the lens 81 as a lightguide body provided on the lightguide 80 is provided with a light incident portion 81*b* which receives light 90*a* emitted from the LED lamp 90.

The LED lamp 90 is supported by a support means (not shown) at a position facing the light incident portion 81*b* of the lens 81 provided on the lightguide 80 on the main body side of the image forming apparatus 7. A control unit serving as a control means (not shown) turns on/off the LED lamp 90 at a predetermined timing.

<Lightguide>

The arrangement of the lightguide 80 will be described with reference to FIGS. 2 and 3.

As shown in FIGS. 2 and 3, the lightguide 80 includes the lens 81 having an almost columnar shape serving as a lightguide body which guides the light 90*a* received from the LED lamp 90 to the surface of the photosensitive drum 1 by transmitting and reflecting the light. In addition, the lightguide 80 includes an exterior case 82 (a housing) having a white inner surface 82*b* for improving the reflection efficiency of the lens 81.

The light 90*a* from the LED lamp 90 is made to enter the light incident portion 81*b* as the end face of the lens 81 in the axial direction.

As shown in FIG. 2, the exterior case 82 is provided with a light irradiation opening 82*a* (an opening) corresponding to a width required for the charge-elimination at a position facing the surface of the photosensitive drum 1.

The lens 81 serving as a lightguide body guides the light 90*a* emitted from the LED lamp 90 serving as a light source to the surface of the photosensitive drum 1.

This makes the light 90*a* emitted from the LED lamp 90 enter the lens 81 through the light incident portion 81*b* as the end face of the lens 81 in the axial direction. Subsequently, the light is reflected by the white inner surface 82*b* of the exterior case 82 and irradiated, as the charge eliminating light 8*a*, from the light irradiation opening 82*a* to the charge eliminated portion L on the surface of the photosensitive drum 1.

The exterior case 82 is configured as a light-shielding member to inhibit the light 90*a* emitted from the LED lamp 90 from irradiating any portion other than the light irradiation opening 82*a*. In this embodiment, the charge eliminating light 8*a* emerging from the charge eliminating device 8 has an exposure width $L_{PE}$ in the axial direction of the light irradiation opening 82*a* of the charge eliminating device 8.

In this embodiment, the distance from an end face 80*a* of the lightguide 80 which is located on the side where the light irradiation opening 82*a* is provided to the surface of the photosensitive drum 1 is set to about 4 mm.

As shown in FIG. 3, the outer peripheral surface of the lens 81 is provided with a plurality of grooves 81*a* serving as a reflecting portion, each having a V-shaped section, at an opposite position to the light irradiating direction side of the light irradiation opening 82*a* indicated by the arrow W direction in FIG. 2.

The plurality of grooves 81*a* serving as a reflecting portion, each having a V-shaped section, are provided side by side along a direction perpendicular to the axial direction, throughout almost the entire axial region on the outer peripheral surface of the lens 81. The grooves 81*a*, each having a V-shaped section, are formed from concave/convex portions each having a triangular section.

The grooves 81*a* function as a reflecting portion which reflects the light 90*a* introduced from the light incident portion 81*b* to the surface side of the photosensitive drum 1 which is indicated by the arrow W direction in FIG. 3.

That is, the outer peripheral surface of the lens 81 serving as a lightguide body is provided with the plurality of grooves 81*a* serving as a reflecting portion, each having a V-shaped section, in the rotation axis direction of the photosensitive drum 1.

<End Portion Collection Failure>

A transfer residual toner collection failure at an end portion of the photosensitive drum 1 in the axial direction, which has been revealed by studies conducted by the inventors, will be described.

End regions on the surface of the photosensitive drum 1 in the axial direction which are not in contact with the transfer roller 5 are irradiated with the charge eliminating light 8*a* emerging from the charge eliminating device 8.

This makes it impossible for the developing device 3 to collect transfer residual toner on the end portions of the surface of the photosensitive drum 1 in the axial direction. As a result, transfer residual toner is left on the surface of the photosensitive drum 1, thus causing a collection failure. This phenomenon that transfer residual toner is left on the end portions of the surface of the photosensitive drum 1 in the axial direction will be referred to as an "end portion collection failure" hereinafter.

Figure 5:
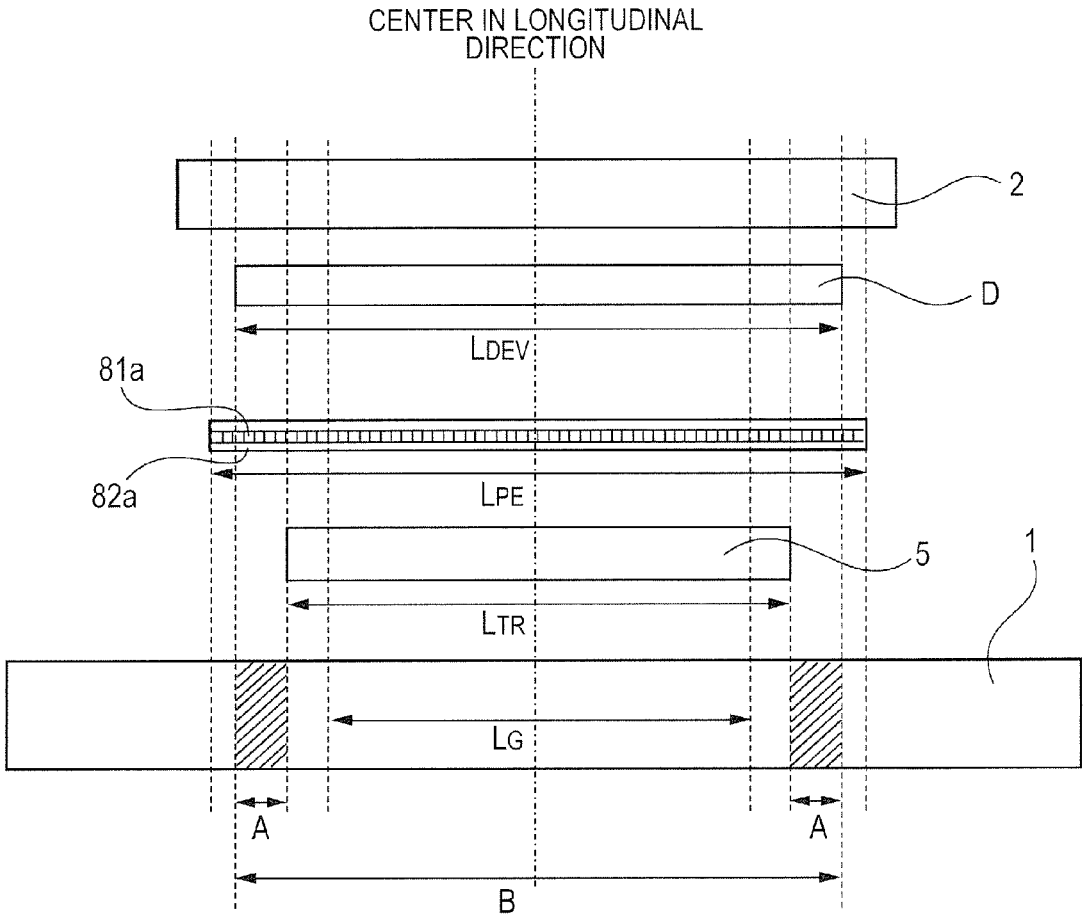
FIG. 5 is a view showing the placement of the developer bearing portion, transfer roller, light irradiation opening of the charge eliminating device, charging roller, and photosensitive drum of a comparative example.

A mechanism of causing an end portion collection failure will be described by using the comparative example shown in FIG. 5. FIG. 5 shows the positional relationship between the developer bearing portion D, the transfer roller 5, the light irradiation opening 82*a* of the charge eliminating device 8, the charging roller 2, and the photosensitive drum 1 of the comparative example in the longitudinal direction.

As shown in FIG. 5, the centers of the developer bearing portion D, the transfer roller 5, the light irradiation opening 82*a* of the charge eliminating device 8, the charging roller 2, and the photosensitive drum 1 in the longitudinal direction are located on the same line.

A region B, on the surface of the photosensitive drum 1, faces the developer bearing portion D as a toner coat region on the surface of the developing sleeve 31. In the region B, toner (fogging toner) which cannot have charge (with almost zero charge) exists on the surface of the photosensitive drum 1.

A region within the region B shown in FIG. 5, where the transfer roller 5 is in contact with the photosensitive drum 1, receives discharge at the transfer portion b. This positively polarizes the fogging toner on the surface of the photosensitive drum 1.

End regions A within the region B shown in FIG. 5, where the transfer roller 5 is not in contact with the photosensitive drum 1, receive no discharge at the transfer portion b. For this reason, the fogging toner on the surface of the photosensitive drum 1 has almost zero charge.

After the photosensitive drum 1 rotates in the arrow R1 direction shown in FIG. 1 and passes through the transfer portion b, the surface of the photosensitive drum 1 is irradiated with the charge eliminating light 8*a* from the charge eliminating device 8 to charge-eliminate the surface potential of the photosensitive drum 1. As a consequence, the fogging toner on the surface of the photosensitive drum 1 within the region B shown in FIG. 5 is negatively polarized by strong discharge when passing through the charged portion c shown in FIG. 1.

Within the region B shown in FIG. 5, there is a region where the transfer roller 5 is in contact with the surface of the photosensitive drum 1. In this region, the fogging toner on the surface of the photosensitive drum 1 is positively polarized at the transfer portion b before passing through the charged portion c shown in FIG. 1.

For this reason, the fogging toner in this region is made to become negative toner with a proper charge amount by strong discharge when passing through the charged portion c shown in FIG. 1. As a result, the developing device 3 can collect the negative toner.

In the end regions A within the region B shown in FIG. 5, the transfer roller 5 is not in contact with the surface of the photosensitive drum 1, and the fogging toner on the surface of the photosensitive drum 1 has almost zero charge before passing through the charged portion c shown in FIG. 1.

For this reason, the fogging toner in the end regions A is made to become strong negative toner with an excessive charge amount by strong discharge when passing through the charged portion c shown in FIG. 1.

As a result, in the end regions A shown in FIG. 5, the reflection force between the photosensitive member and the toner becomes too high to allow the developing device 3 to collect the toner. As a consequence, transfer residual toner is left on the surface of the photosensitive drum 1 at positions indicated by the hatched portions in FIG. 5, thus causing an end portion failure.

A toner coat state is unstable on the end portions of the developer bearing portion D in the longitudinal direction, in particular. This makes collection by the developing device 3 unstable, and hence tends to cause an end portion collection failure.

Transfer residual toner left on the surface of the photosensitive drum 1 because of an end portion collection failure is gradually accumulated on the surface of the photosensitive drum 1. This forms a ring-like toner aggregate on the surface of the photosensitive drum 1.

The ring-like toner aggregate formed on each end portion of the surface of the photosensitive drum 1 in the longitudinal direction is called an "end portion toner ring" hereinafter. When end portion toner rings are formed on the end portions of the surface of the photosensitive drum 1 in the longitudinal direction in this manner, an image failure such as edge stain (stain on end portions of the recording medium P) is sometimes caused by density unevenness or toner scatter due to a contact failure at each end portion of the surface of the photosensitive drum 1 in the longitudinal direction.

<End Portion Collection Failure Prevention>

Figure 4:
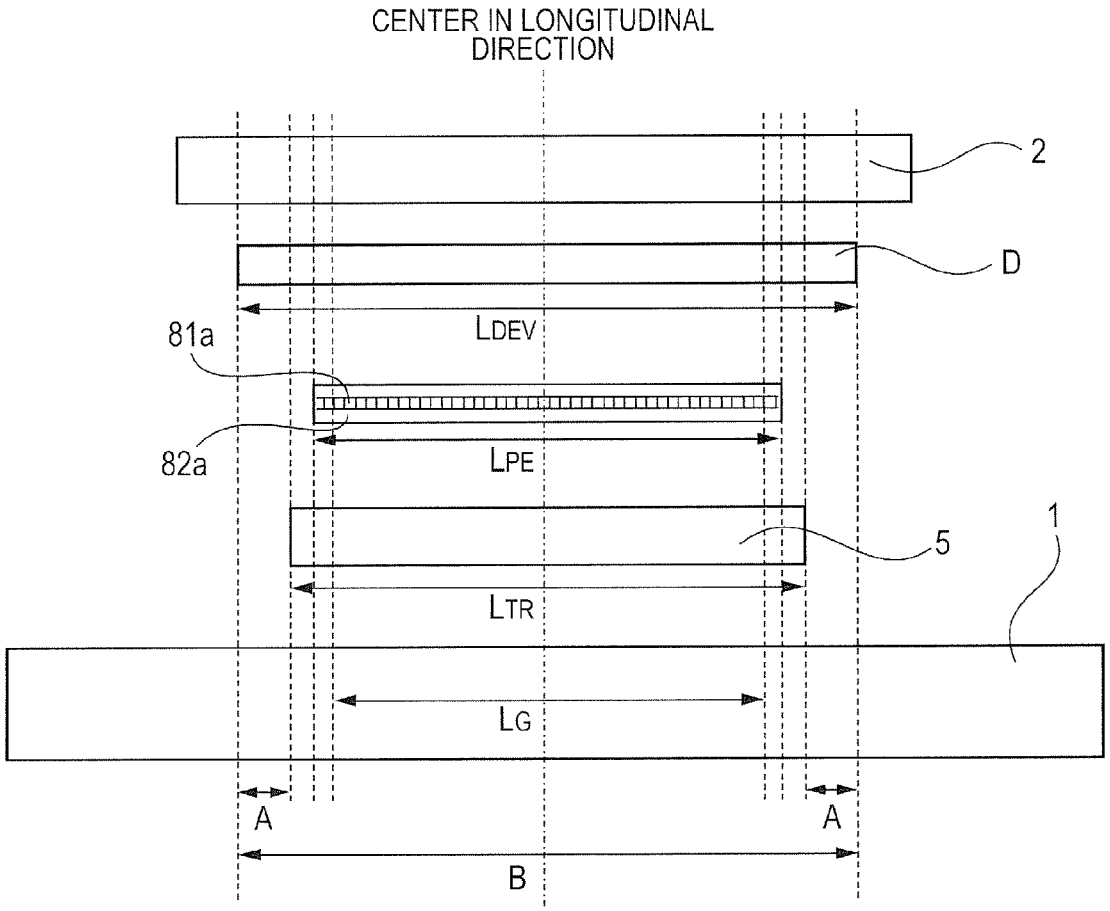
FIG. 4 is a view showing the placement of the developer bearing portion, transfer roller, light irradiation opening of the charge eliminating device, charging roller, and photosensitive drum of the image forming apparatus according to the first embodiment in the longitudinal direction.

An arrangement configured to prevent an end portion collection failure, which is a feature of this embodiment, will be described with reference to FIG. 4. FIG. 4 shows the positional relationship between the developer bearing portion D, the transfer roller 5, the light irradiation opening 82*a* of the charge eliminating device 8, the charging roller 2, and the photosensitive drum 1 of this embodiment.

The length of the coating portion of the charging roller 2 capable of performing a charging process by coming into contact with the surface of the photosensitive drum 1 in the longitudinal direction was set to 250 mm. The length of the pressure contact portion of the charging roller 2 which is in pressure contact with the surface of the photosensitive drum 1 was set to 230 mm.

The length of the developer bearing portion D (a toner coat region) shown in FIG. 4 was set to 222 mm. The length of the pressure contact portion of the transfer roller 5 in the longitudinal direction was set to 215 mm.

The length of the light irradiation opening 82*a* in the longitudinal direction was set to 212 mm. As shown in FIG. 4, the centers of the developer bearing portion D, the transfer roller 5, the light irradiation opening 82*a* of the charge eliminating device 8, the charging roller 2, and the photosensitive drum 1 in the longitudinal direction are located on the same line.

The light irradiation opening 82*a* of the charge eliminating device 8 needs to be located inwardly from the developer bearing portion D in consideration of a mechanism of causing an end portion collection failure. The light irradiation opening 82*a* of the charge eliminating device 8 can be located inwardly from the transfer roller 5.

The developer bearing portion D has the length $L_{DEV}$. The developer bearing portion D corresponds to a region, which carries toner, on the surface of the developing sleeve 31 of the developing device 3 in the rotation axis direction of the photosensitive drum 1 (the lateral direction in FIG. 4). The transfer roller 5 has a length $L_{TR}$ in the longitudinal direction (the lateral direction in FIG. 4). The light irradiation opening 82*a* of the charge eliminating device 8 has a length $L_{PE}$ in the longitudinal direction (the lateral direction in FIG. 4.).

As shown in FIG. 4, the length $L_{DEV}$, the length $L_{TR}$, and the length $L_{PE}$ are set such that their relationship satisfies inequality (1) given below.

$$L_{PE}<L_{TR}\leq L_{DEV} \quad (1)$$

In the rotation axis direction of the photosensitive drum 1 (the lateral direction in FIG. 4), the length (exposure width) $L_{PE}$ of the light irradiation opening 82*a* of the charge eliminating device 8 in the longitudinal direction shown in FIG. 4 is shorter than the length $L_{DEV}$ of the developer bearing portion D.

The length (exposure width) $L_{PE}$ of the light irradiation opening 82*a* of the charge eliminating device 8 in the longitudinal direction shown in FIG. 4 approximately includes a length $L_G$ of the image formation region on the surface of the photosensitive drum 1 in the longitudinal direction of the photosensitive drum 1 (the lateral direction in FIG. 4).

In addition, as shown in FIG. 4, the light irradiation opening 82*a* is arranged within a range of the length of the transfer roller 5 in the longitudinal direction of the light irradiation opening 82*a*.

Comparative Example

The arrangement of the comparative example shown in FIG. 5 will be described to inspect the effects of this embodiment shown in FIG. 4. FIG. 5 shows the positional relationship between the developer bearing portion D, the transfer roller 5, the light irradiation opening 82*a* of the charge eliminating device 8, the charging roller 2, and the photosensitive drum 1 of the comparative example in each longitudinal direction thereof.

The comparative example shown in FIG. 5 gives consideration to the length $L_{DEV}$ of the developer bearing portion D in the longitudinal direction (the lateral direction in FIG. 5). In addition, this comparative example gives consideration to the length $L_{TR}$ of the transfer roller 5 in the longitudinal direction (the lateral direction in FIG. 5). The comparative example further gives consideration to the length $L_{PE}$ of the light irradiation opening 82*a* of the charge eliminating device 8 in the longitudinal direction (the lateral direction in FIG. 5). The relationship between them is set to satisfy inequality (2) given below.

$$L_{PE}\geq L_{DEV}>L_{TR} \quad (2)$$

The length $L_{PE}$ of the light irradiation opening 82*a* of the comparative example shown in FIG. 5 in the longitudinal direction was set to 225 mm.

<Light Reception Amount Distributions of Embodiment and Comparative Example>

Figure 6:
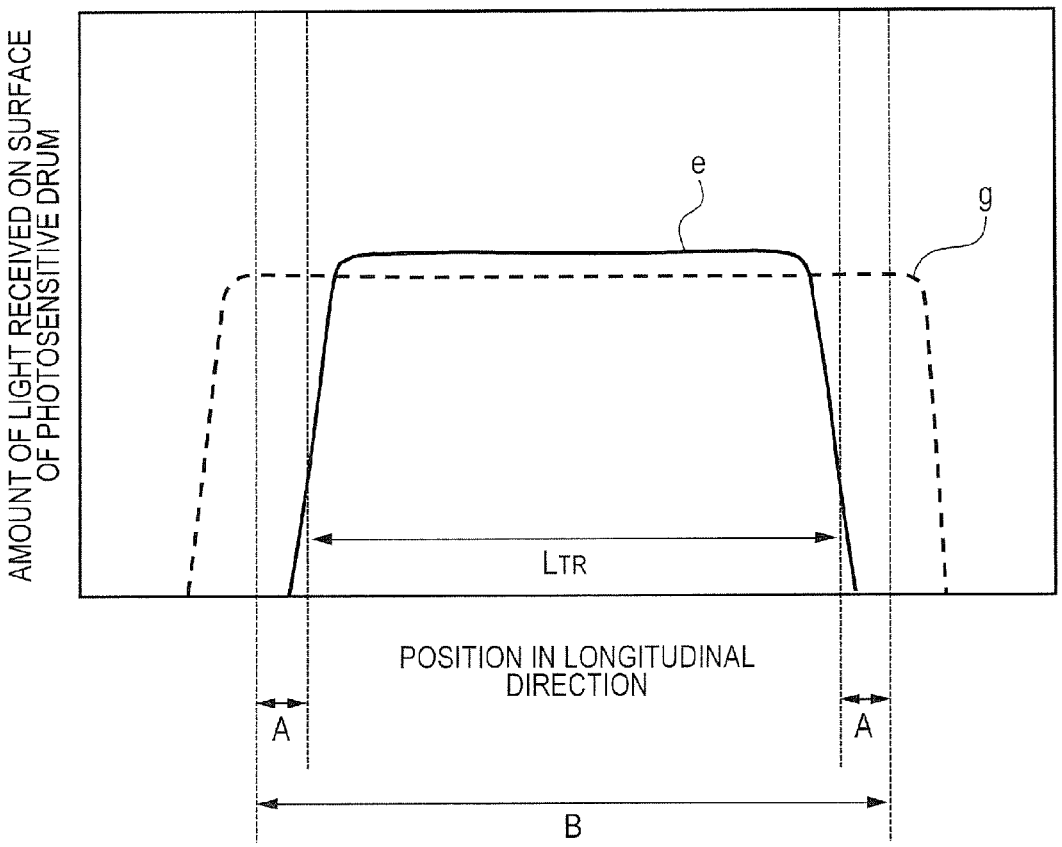
FIG. 6 is a graph comparatively showing the distributions of the amounts of light received on the surfaces of the photosensitive drums in the longitudinal direction according to the first embodiment and the comparative example.

FIG. 6 shows the distributions of the amounts of light received on the surfaces of the photosensitive drums 1 in the longitudinal direction according to this embodiment shown in FIG. 4 and the comparative example shown in FIG. 5.

A distribution curve e indicated by the solid line in FIG. 6 indicates the distribution of the amounts of light received on the surface of the photosensitive drum 1 in the longitudinal direction according to this embodiment shown in FIG. 4. A distribution curve g indicated by the broken line in FIG. 6 indicates the distribution of the amounts of light received on the surface of the photosensitive drum 1 in the longitudinal direction according to the comparative example shown in FIG. 5.

In this embodiment shown in FIG. 4, the length $L_{PE}$ (exposure width) of the light irradiation opening 82*a* of the charge eliminating device 8 in the longitudinal direction is shorter than the length $L_{TR}$ (the width of the transfer member) of the transfer roller 5 in the longitudinal direction.

The exposure width of the charge eliminating device 8 in the rotation axis direction of the photosensitive drum 1 (the lateral direction in FIG. 4) is the width (light irradiation opening width) of the light irradiation opening 82*a* of the lightguide 80 which faces the surface of the photosensitive drum 1.

This suppresses the irradiation of the end regions A, where the transfer roller 5 is not in contact with the surface of the photosensitive drum 1, with the charge eliminating light 8*a* emerging from the charge eliminating device 8, within the region B shown in FIG. 6.

As indicated by the distribution curve e in FIG. 6, in the rotation axis direction of the photosensitive drum 1 (the lateral direction in FIG. 4), this can reduce (weaken) the amount of charge eliminating light 8*a* from the charge eliminating device 8 received in each end region A on the surface of the photosensitive drum 1 as compared with the middle portion in the longitudinal direction.

In the comparative example shown in FIG. 5, the length $L_{PE}$ of the light irradiation opening 82*a* of the charge eliminating device 8 in the longitudinal direction is longer than the length $L_{TR}$ of the transfer roller 5 in the longitudinal direction.

For this reason, within the region B shown in FIG. 6, each end region A, where the transfer roller 5 is not in contact with the surface of the photosensitive drum 1, is irradiated with the charge eliminating light 8*a* emerging from the charge eliminating device 8.

As indicated by the distribution curve g in FIG. 6, this makes the amount of light received in each end region A on the surface of the photosensitive drum 1 almost equal to that on the middle portion in the longitudinal direction and larger than that in each end region A indicated by the distribution curve e in FIG. 6.

<Inspection of Effects of Arrangement for Prevention of End Portion Collection Failure>

Figures 7, 8:
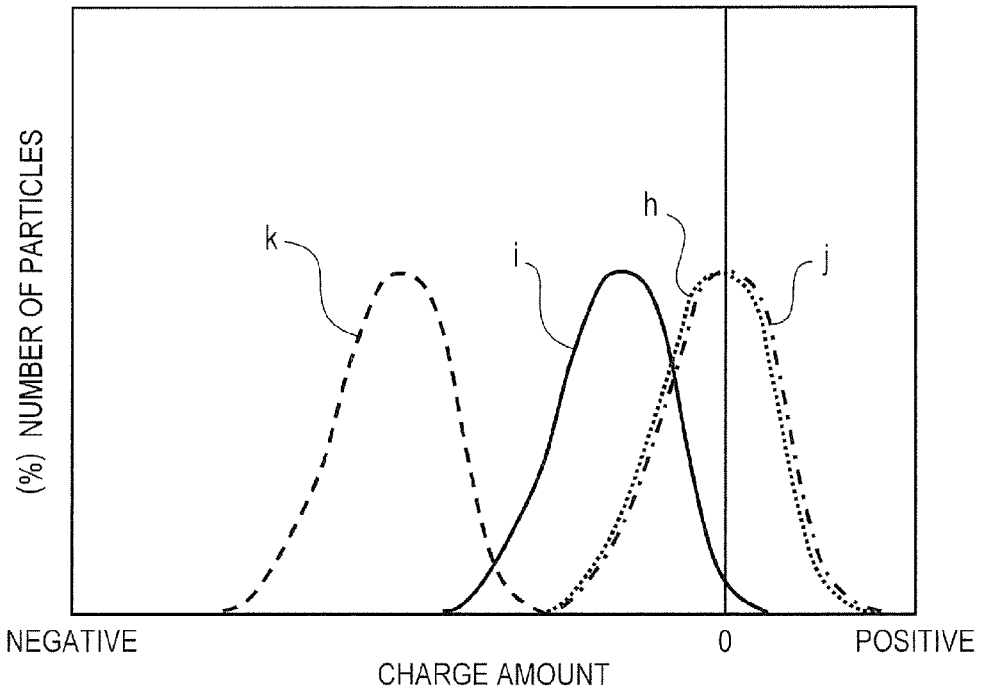
FIG. 7 is a graph comparatively showing the distributions of the charge amounts of toner on the surfaces of the drums according to the first embodiment and the comparative example before and after the passage of the charging rollers through end regions A in the longitudinal direction.
FIG. 8 is a view showing inspection results according to the first embodiment and the comparative example.

FIG. 7 shows the distributions of the charge amounts of transfer residual toner left on the surfaces of the photosensitive drums 1 before and after the end regions A in FIGS. 4 and 5 pass through the charging rollers 2 in this embodiment shown in FIG. 4 and the comparative example shown in FIG. 5. The vertical axis in FIG. 7 indicates values of the number of particles corresponding to each charge amount calculated in ratio when the total number of particles measured by the "E-SPART Analyzer (trade name)" available from Hosokawa Micron Corporation is assumed to be 100%.

A distribution curve h indicated by the broken line in FIG. 7 indicates the charge amount distribution of transfer residual toner left on the surface of the photosensitive drum 1 before each end region A in this embodiment shown in FIG. 4 passes through the charging roller 2.

A distribution curve i indicated by the solid line in FIG. 7 indicates the charge amount distribution of transfer residual toner left on the surface of the photosensitive drum 1 after each end region A in this embodiment shown in FIG. 4 passes through the charging roller 2.

A distribution curve j indicated by the chain line in FIG. 7 indicates the charge amount distribution of transfer residual toner left on the surface of the photosensitive drum 1 before each end region A in the comparative example shown in FIG. 5 passes through the charging roller 2.

A distribution curve k indicated by the solid line in FIG. 7 indicates the charge amount distribution of transfer residual toner left on the surface of the photosensitive drum 1 after each end region A in the comparative example shown in FIG. 5 passes through the charging roller 2.

The "E-SPART Analyzer (trade name)" available from Hosokawa Micron Corporation was used to measure the charge amount distribution of toner in each end region A on the photosensitive drum 1.

As indicated by the distribution curves j and h in FIG. 7, both the charge amounts of transfer residual toner left in the end regions A on the surfaces of the photosensitive drums 1 before passage through the charging rollers 2 according to this embodiment shown in FIG. 4 and comparative example shown in FIG. 5 are almost zero "0".

In this embodiment shown in FIG. 4, irradiation of the end regions A on the surface of the photosensitive drum 1 with the charge eliminating light 8*a* emerging from the charge eliminating device 8, is suppressed.

Thereby, regarding the toner after passing through the charging roller 2, discharge at the charged portion c shown in FIG. 1 when the charged portion c passes through the charging roller 2 is suppressed.

As indicated by the distribution curve i in FIG. 7, this suppresses the strong negative polarization of toner in the end regions A on the surface of the photosensitive drum 1, thereby obtaining negative toner with a proper charge amount.

In the comparative example shown in FIG. 5, each end region A on the surface of the photosensitive drum 1 is irradiated with the charge eliminating light 8*a* emerging from the charge eliminating device 8.

As indicated by the distribution curve k in FIG. 7, the toner after passing through the charging roller 2 is strongly negatively polarized by discharge at the charged portion c shown in FIG. 1 when passing through the charging roller 2.

FIG. 8 shows inspection results in this embodiment shown in FIG. 4 and the comparative example shown in FIG. 5. As an inspection method, tests were executed by actually printing on the recording medium P using this embodiment and the comparative example.

In an evaluation environment in which the temperature was 23° C. and the humidity was 60% RH (Relative Humidity), an endurance test using 3,000 recording media P as letter size paper sheets was conducted by printing test images on them under a condition of intermittently printing per two sheets. The condition of intermittently printing per two sheets is a printing condition that printing is repeated as follows: continuously printing on two recording media P, stopping the photosensitive drum 1, and then continuously printing on two recording media P again.

As shown in FIG. 8, in this embodiment shown in FIG. 4, no end portion collection failure occurred, no end portion toner ring was formed, and no edge stain was produced.

In the comparative example shown in FIG. 5, an end portion collection failure occurred when 50 recording media P were fed. When 100 recording media P were fed, end portion toner rings were formed. When 200 recording media P were fed, edge stain was produced.

In this embodiment shown in FIG. 4, in the longitudinal direction indicated by the lateral direction in FIG. 4, the length $L_{PE}$ (opening width) of the light irradiation opening 82*a* of the charge eliminating device 8 in the longitudinal direction is set to be shorter than the length $L_{TR}$ (width) of the transfer roller 5 in the longitudinal direction.

This can suppress irradiation of the end regions A, where the transfer roller 5 is not in contact with the photosensitive drum 1 within the region B shown in FIG. 4, with the charge eliminating light 8*a* emerging from charge eliminating device 8.

As a result, in the end regions A on the surface of the photosensitive drum 1, it is possible to suppress the collection failure of the transfer residual toner by suppressing discharge at the charged portion c shown in FIG. 1 and suppressing the strong negative polarization of transfer residual toner.

This can suppress the collection failure of the transfer residual toner in the end regions A on the surface of the photosensitive drum 1 in this embodiment shown in FIG. 4.

It is therefore possible to provide the image forming apparatus 7 having the cleanerless system which can suppress troubles in the end regions A on the surface of the photosensitive drum 1.

In this embodiment, as shown in FIGS. 2 and 3, the charge eliminating device 8 includes the LED lamp 90 supported on the main body side of the image forming apparatus 7 and the lightguide 80 supported on the process cartridge 9 side.

In addition, a chip array having an array of a plurality of LEDs (Light Emitting Diodes) may be provided as the charge eliminating device 8 so as to face the surface of the photosensitive drum 1.

In this embodiment, the developing device 3 shown in FIG. 2 includes no developer supply roller for supplying toner to the developing sleeve 31.

Alternatively, the developing device 3 may include a developer supply roller for supplying toner to the developing sleeve 31.

In this embodiment, as an example, the inner surface 82*b* of the exterior case 82 of the lightguide 80 shown in FIG. 2 is constructed from a white light-shielding member. Alternatively, the exterior case 82 and the light-shielding member may be formed from different members.

In this embodiment, as an example, the inner surface 82*b* of the exterior case 82 of the lightguide 80 is constructed from a white light-shielding member.

Alternatively, a light-shielding member may be arranged near the surface of the photosensitive drum 1 separately from the exterior case 82 of the lightguide 80.

For example, a light-shielding member (not shown) may be arranged between the photosensitive drum 1 and the charge eliminating device 8 in the irradiation direction (the arrow W direction in FIGS. 2 and 3) of the charge eliminating light 8*a* (light) irradiated from the charge eliminating device 8 on the surface of the photosensitive drum 1.

According to this embodiment, it is possible to suppress troubles at the end portions of the photosensitive drum 1 of the imaging forming apparatus having the cleanerless system.

Second Embodiment

The arrangement of an image forming apparatus according to the second embodiment will be described next with reference to FIGS. 9A, 9B, and 10. Note that the same components as those in the first embodiment are denoted by the same reference numerals or the same terms with different reference numerals, and a description of them will be omitted.

In the first embodiment shown in FIG. 4, it is suppressed to irradiate on the end regions A, where the transfer roller 5 is not in contact with the surface of the photosensitive drum 1, with the charge eliminating light 8*a* emerging from the charge eliminating device 8.

For this purpose, in the longitudinal direction indicated by the lateral direction in FIG. 4, the length $L_{PE}$ (opening width) of the light irradiation opening 82*a* of the charge eliminating device 8 in the longitudinal direction is set to be shorter than the length $L_{TR}$ (width) of the transfer roller 5 in the longitudinal direction.

In the first embodiment shown in FIG. 4, the grooves 81*a*, each having a V-shaped section and a triangular section, are arranged on the opposite side to the irradiation direction of the charge eliminating light 8*a* indicated by the arrow W direction in FIG. 3. The grooves 81*a* are provided throughout almost the entire axial region on the outer peripheral surface of the lens 81.

Figure 9A:
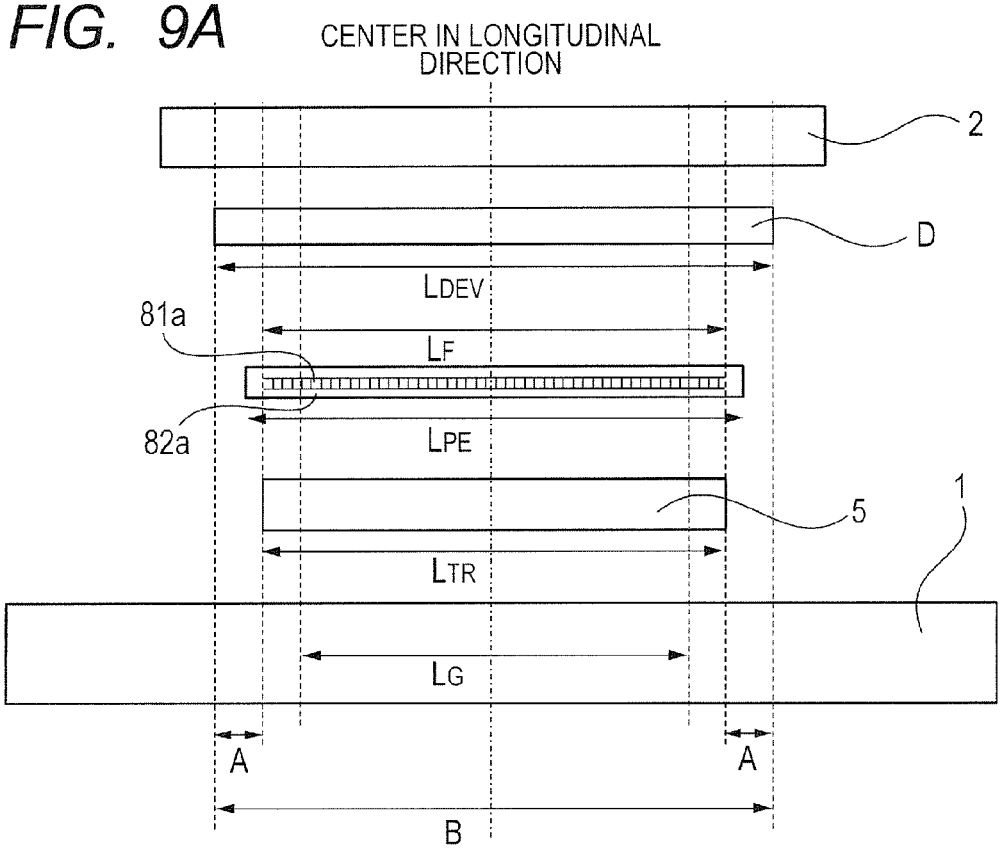
FIG. 9A is a view showing the placement of the developer bearing portion, transfer roller, light irradiation opening of the charge eliminating device, charging roller, and photosensitive drum of an image forming apparatus according to the second embodiment in the longitudinal direction.
Figure 9B:
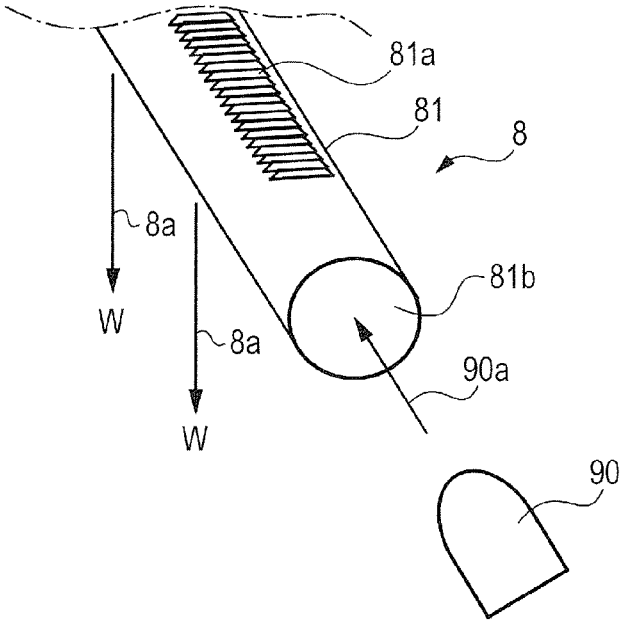
FIG. 9B is a perspective view for explaining the arrangement of the lens of a charge eliminating device according to the second embodiment.

In the second embodiment, grooves 81*a* (a reflecting portion), each having a V-shaped section and a triangular section, are arranged on the opposite side to the irradiation direction of charge eliminating light 8*a* indicated by the arrow W direction in FIG. 9B. The grooves 81*a* are provided on the outer surface of a lens 81 along the axial direction, in the following manner. The grooves 81*a*, each having a V-shaped section, are not provided in regions corresponding to the end regions A on the surface of a photosensitive drum 1. Other arrangements are the same as those in the first embodiment.

FIG. 9A shows the positional relationship between a developer bearing portion D, a transfer roller 5, a light irradiation opening 82*a* of a charge eliminating device 8, a charging roller 2, and the photosensitive drum 1 of this embodiment in the longitudinal direction.

FIG. 9B is a perspective view for explaining the arrangement of the lens 81 of the charge eliminating device 8 according to this embodiment.

A region, where the grooves 81*a*, each having a V-shaped section and a triangular section, are formed on the outer peripheral surface of the lens 81 shown in FIG. 9A along the axial direction, has a length $L_F$ in the longitudinal direction (the lateral direction in FIG. 9A).

In this embodiment, the length $L_F$ of the grooves 81*a* in the longitudinal direction (the lateral direction in FIG. 9A) was set to 215 mm.

In this embodiment, the grooves 81*a*, each having a V-shaped section, are not provided on the outer peripheral surface of the lens 81 in the region corresponding to the end regions A, where the transfer roller 5 is not in contact with the surface of the photosensitive drum 1, within a region B shown in FIG. 9A.

As shown in FIG. 9B, light 90*a* emitted from an LED lamp 90 supported on the image forming apparatus 7 side is introduced from a light incident portion 81*b* provided at an end portion of the lens 81 in the longitudinal direction.

Subsequently, in the region corresponding to the end regions A on the surface of the photosensitive drum 1, the light 90*a* is not reflected toward the surface of the photosensitive drum 1 (in the arrow W direction in FIG. 9B).

In this embodiment, the exposure width of the charge eliminating device 8 in the longitudinal direction (the lateral direction in FIG. 9A) is set as follows. As shown in FIG. 9A, the exposure width is the width (the length $L_F$ in the longitudinal direction) of the region throughout which the grooves 81*a*, each having a V-shaped section, are formed, which serve as a reflecting portion provided on the outer peripheral surface of the lens 81 as a lightguide body along the axial direction. The length $L_F$ of the reflecting portion 81*a* is equal to or shorter than the length of the transfer roller 5 in the longitudinal direction of the light irradiation opening 82*a*. As shown in FIG. 9A, the reflecting portion 81*a* is arranged within the range of the length of the transfer roller 5 in the longitudinal direction of the light irradiation opening 82*a*.

Part of the reflecting portion 81*a* may be arranged outside the range of the length of the transfer roller 5 in the longitudinal direction of the light irradiation opening 82*a*. For example, the reflecting portion 81*a* is sometimes used, with the reflecting direction of light reflected by the reflecting portion 81*a* (the direction in which light emerges from the charge eliminating device 8 toward the surface of the photosensitive drum 1) tilting with respect to a normal line to the surface of the photosensitive drum 1. In this case, in order to inhibit light from being reflected to the end regions A on the surface of the photosensitive drum 1, the reflecting portion 81*a* is arranged at a position shifted (offset) from the range of the length of the transfer roller 5 in the longitudinal direction of the light irradiation opening 82*a* in consideration of the reflecting direction of the reflecting portion 81*a*.

Figure 10:
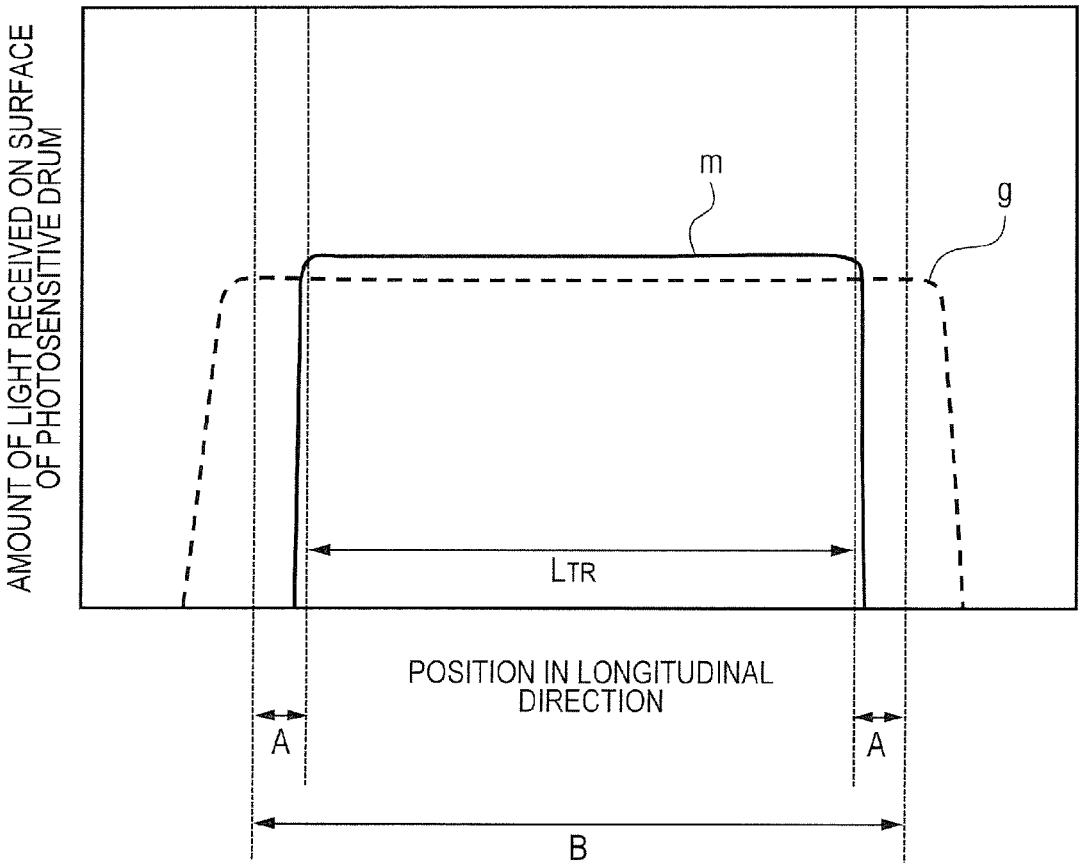
FIG. 10 is a graph comparatively showing the distributions of the amounts of light received on the surfaces of the photosensitive drums in the longitudinal direction according to the second embodiment and the comparative example.

FIG. 10 shows the distributions of the amounts of light received on the surfaces of the photosensitive drums 1 in the longitudinal direction in this embodiment shown in FIG. 9A and the comparative example shown in FIG. 5.

In this embodiment shown in FIG. 9A, the grooves 81*a*, each having a V-shaped section, are not provided on the outer peripheral surface of the lens 81 in the region corresponding to the end regions A on the surface of the photosensitive drum 1. For this reason, as indicated by a distribution curve m indicated by the solid line in FIG. 10, the amount of light received on the surface of the photosensitive drum 1 steeply decreases at positions outside the end portions of the transfer roller 5 in the longitudinal direction of the transfer roller 5 within the region B.

As a result, the amount of light received on the surface of the photosensitive drum 1 in each end region A on the surface of the photosensitive drum 1 greatly decreases as compared with the comparative example indicated by a distribution curve g in FIG. 10.

This can suppress discharge at the charged portion c shown in FIG. 1 and suppress strong negative polarization of transfer residual toner in the end regions A on the surface of the photosensitive drum 1. This makes it possible to suppress transfer residual toner collection failures in the end regions A on the surface of the photosensitive drum 1. Other arrangements are the same as those in the first embodiment, and similar effects can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-181542, filed Sep. 15, 2015, which is hereby incorporated by reference herein in its entirety.

What is claimed is:

1. An image forming apparatus, which forms an image on a recording medium, comprising:

an image bearing member;

a charging device coming into contact with the image bearing member at a charging portion to charge the image bearing member;

a developing device supplying developer to the image bearing member to form a developer image;

a transfer member transferring the developer image formed on the image bearing member onto a transfer target material at a transfer portion; and a charge eliminating device irradiating a surface of the image bearing member with light from an exposure opening before the surface reaches the charging portion after passing through the transfer portion, wherein a length of a developer bearing portion of the developing device is longer than a length of the transfer member in a rotation axis direction of the image bearing member, and a width of the exposure opening of the charge eliminating device is shorter than the length of the transfer member in the rotation axis direction of the image bearing member.

2. An image forming apparatus according to claim 1, wherein the exposure opening is arranged within a range of the length of the transfer member in the rotation axis direction of the image bearing member.

3. An image forming apparatus according to claim 1, wherein the charge eliminating device has a light-shielding member configured to form the exposure opening.

4. An image forming apparatus according to claim 1, wherein the charge eliminating device has a light source and a reflecting portion and irradiates a surface of the image bearing member with light emitted from the light source and reflected by the reflecting portion, and a width of the reflecting portion of the charge eliminating device is shorter than the length of the transfer member in the rotation axis direction of the image bearing member.

5. An image forming apparatus according to claim 4, wherein the charge eliminating device has a lightguide body in which the light emitted from the light source enters, and the reflecting portion is provided on the lightguide body.

6. An image forming apparatus according to claim 1, wherein, in a distribution of light reception amounts on the image bearing member from the charge eliminating device in the rotation axis direction of the image bearing member, a maximum value of a light reception amount in a region outside a region corresponding to the transfer member on the image bearing member is smaller than a maximum value of a light reception amount in the region corresponding to the transfer member on the image bearing member.

7. An image forming apparatus according to claim 1, wherein a part of the surface of the image bearing member, which has passed through the transfer portion, reaches the charging portion without being cleaned of the developer left on the surface of the image bearing member without being transferred at the transfer portion, and the developing device is configured to collect the developer left on the surface of the image bearing member without being transferred at the transfer portion.

8. An image forming apparatus, which forms an image on a recording medium, comprising:

an image bearing member;

a charging device coming into contact with the image bearing member at a charging portion to charge the image bearing member;

a developing device supplying developer to the image bearing member to form a developer image;

a transfer member transferring the developer image formed on the image bearing member onto a transfer target material at a transfer portion; and a charge eliminating device having a light source and a reflecting portion and irradiating a surface of the image bearing member with light which is emitted from the light source and reflected by the reflecting portion before the surface reaches the charging portion after passing through the transfer portion, wherein a length of a developer bearing portion of the developing device is longer than a length of the transfer member in a rotation axis direction of the image bearing member, and a width of the reflecting portion of the charge eliminating device is equal to or shorter than the length of the transfer member in the rotation axis direction of the image bearing member.

9. An image forming apparatus according to claim 8, wherein the reflecting portion is arranged within a range of the length of the transfer member in the rotation axis direction of the image bearing member.

10. An image forming apparatus according to claim 8, wherein the charge eliminating device has a lightguide body in which the light emitted from the light source enters, and the reflecting portion is provided on the lightguide body.

11. An image forming apparatus according to claim 8, wherein, in a distribution of light reception amounts on the image bearing member from the charge eliminating device in the rotation axis direction of the image bearing member, a maximum value of a light reception amount in a region outside a region corresponding to the transfer member on the image bearing member is smaller than a maximum value of a light reception amount in the region corresponding to the transfer member on the image bearing member.

12. An image forming apparatus according to claim 8, wherein a part of the surface of the image bearing member, which has passed through the transfer portion, reaches the charging portion without being cleaned of the developer left on the surface of the image bearing member without being transferred at the transfer portion, and the developing device is configured to collect the developer left on the surface of the image bearing member without being transferred at the transfer portion.

13. An image forming apparatus, which forms an image on a recording medium, comprising:

an image bearing member;

a charging device coming into contact with the image bearing member at a charging portion to charge the image bearing member;

a developing device supplying developer to the image bearing member to form a developer image;

a transfer member transferring the developer image formed on the image bearing member onto a transfer target material at a transfer portion; and a charge eliminating device irradiating a surface of the image bearing member with light from an exposure opening before the surface reaches the charging portion after passing through the transfer portion, wherein a length of a developer bearing portion of the developing device is longer than a length of the transfer member in a rotation axis direction of the image bearing member, and in a distribution of light reception amounts on the image bearing member from the charge eliminating device in the rotation axis direction of the image bearing member, a maximum value of a light reception amount in a region outside a region corresponding to the transfer member on the image bearing member is smaller than a maximum value of a light reception amount in the region corresponding to the transfer member on the image bearing member.

14. An image forming apparatus according to claim 13, wherein a part of the surface of the image bearing member, which has passed through the transfer portion, reaches the charging portion without being cleaned of the developer left on the surface of the image bearing member without being transferred at the transfer portion, and the developing device is configured to collect the developer left on the surface of the image bearing member without being transferred at the transfer portion.

15. A cartridge to be mounted in an image forming apparatus which has a transfer member transferring a developer image formed on an image bearing member onto a transfer target material at a transfer portion, the cartridge comprising:

the image bearing member;

a charging member coming into contact with the image bearing member at a charging portion to charge the image bearing member; and a lightguide unit having an exposure opening from which a surface of the image bearing member is irradiated with light before the surface reaches the charging portion after passing through the transfer portion, wherein a width of the exposure opening of the lightguide unit is shorter than a length of the transfer member in a rotation axis direction of the image bearing member.

16. A cartridge according to claim 15, wherein the lightguide unit has a light-shielding member configured to form the exposure opening.

17. A cartridge according to claim 15, wherein the lightguide unit has a reflecting portion and irradiates the surface of the image bearing member with light emitted from a light source and reflected by the reflecting portion, and a width of the reflecting portion of the lightguide unit is shorter than the length of the transfer member in the rotation axis direction of the image bearing member.

18. A cartridge according to claim 17, wherein the lightguide unit has a lightguide body in which the light emitted from the light source enters, and the reflecting portion is provided on the lightguide body.

19. A cartridge according to claim 15, wherein a part of the surface of the image bearing member, which has passed through the transfer portion, reaches the charging portion without being cleaned of the developer left on the surface of the image bearing member without being transferred at the transfer portion.

20. A cartridge to be mounted in an image forming apparatus having a light source and a transfer member transferring a developer image formed on an image bearing member onto a transfer target material at a transfer portion, the cartridge comprising:

the image bearing member;

a charging member coming into contact with the image bearing member at a charging portion to charge the image bearing member; and a lightguide unit having a reflecting portion and irradiating a surface of the image bearing member with light, which is emitted from the light source and reflected by the reflecting portion, before the surface reaches the charging portion after passing through the transfer portion, wherein a width of the reflecting portion of the lightguide unit is equal to or shorter than a length of the transfer member in a rotation axis direction of the image bearing member.

21. A cartridge according to claim 20, wherein the lightguide unit has a lightguide body in which the light emitted from the light source enters, and the reflecting portion is provided on the lightguide body.

22. A cartridge according to claim 20, wherein a part of the surface of the image bearing member, which has passed through the transfer portion, reaches the charging portion without being cleaned of the developer left on the surface of the image bearing member without being transferred at the transfer portion.

* * * * *